United States Patent [19]

Lin

[11] 3,964,668

[45] June 22, 1976

[54] SIMPLE FOLDABLE CONTAINER FOR FOOD AND BEVERAGES

[76] Inventor: Tenhon Lin, No. 53, Tai Ping Road, Hsin Tien, Taipei Hsien, China /Taiwan

[22] Filed: Sept. 23, 1975

[21] Appl. No.: 615,938

[52] U.S. Cl. ..... 229/35; 229/31 R

[51] Int. Cl.[2] ..... B65D 5/26

[58] Field of Search ..... 229/31 R, 31 I, 34 A, 229/34 B, 35

[56] References Cited

UNITED STATES PATENTS

| | | | |
|---|---|---|---|
| 2,085,038 | 6/1937 | Perreton | 229/31 R |
| 2,251,627 | 8/1941 | Johnson | 229/31 I |
| 2,373,730 | 4/1945 | Williamson et al. | 229/34 A |
| 2,676,747 | 4/1954 | Lange | 229/31 R |
| 2,944,719 | 7/1960 | Arneson | 229/31 R |
| 3,131,848 | 5/1964 | Floyd | 229/31 R |
| 3,289,914 | 12/1966 | Lange-Wiehe | 229/31 R |
| 3,567,106 | 3/1971 | Anderson | 229/31 R |
| 3,913,823 | 10/1975 | Lin | 229/35 |

*Primary Examiner*—Davis T. Moorhead

*Attorney, Agent, or Firm*—Shoemaker and Mattare, Ltd.

[57] ABSTRACT

A non-leaking paper container which is manually foldable requiring no other tools or equipment, and more particularly a sheet of thick paper upon which are pressed by means of a roll-press inwardly or outwardly folding lines which, when folded in the correct manner, cause the sheet to form a cup or plate-like container having an opening larger than its base; to be used for foods or beverages.

1 Claim, 15 Drawing Figures

SIMPLE FOLDABLE CONTAINER FOR FOOD AND BEVERAGES

DETAILED DESCRIPTION OF THE INVENTION

The present invention relates to a paper container which is foldable manually with no need for auxiliary tools or equipment to form a non-leaking container, praticularly to a paper sheet having a suitable hardness being treated on at least one side with a water repellent, aluminum foil, plastic film or any suitable waterproof material and which is formed in a

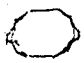

shape to form a blank for a container, whereon are roll-pressed a plurality of inwardly and outwardly folding lines so as to form on the blank one square, six trapezoids, and eight triangles, with the square being centrally located on the blank so as to form the base of the container. Adjacent to said square base on the upper, lower, left and right sides are symetrical trapezoids which form the side walls of the container. Symetrical triangles adjacent to and between the four side walls form corner holding members, and two symetrical trapezoids extending from either the upper and lower or left and right side walls form the end locking panels. Furthermore, a slot is provided at the central portion of the outside edge of both end locking panels, said slot being in the shape of a line, an equilateral triangle or a trapezoid with the outside edge of the end locking panel as the base thereof. Outwardly folding lines are roll-pressed along the diagonals formed between the two outside corners of the end locking panels and the apex of the slot, forming two symetrical triangle having said diagonal fold line as a base. The side walls are folded inwardly or upwardly by virtue of the inwardly folding lines. Again by virtue of inwardly folding lines, the triangles of the corner holding members are folded out towards the side walls adjacent the end locking panels.

The triangular part of the said locking end panels are inserted into the space between the last abovesaid sidewalls and holding corner members, thus, a container having an opening larger than its base is formed.

According to the prior art, many food and beverage containers are known which are formed by applying adhesive edges together or by utilizing end tuck in tabs. These containers are very susceptible to easy breakage and falling apart when carried for an extended period of time. Also known are paper cups which are treated with waterproofing materials of low melting points, making them impractical for hot foods or beverages. Another disadvantage of these paper containers is that due to the volume of area they demand, packing, shipping, and storage is less convenient and more expensive. Moreover, they must go through the blank forming, coating, adhesion, and other processes, causing not only complicated production, but also requiring much expensive machinery, tools and materials, also much wasted production time and labor. These are some of the major disadvantages of the prior art.

The accompanying diagrams of the present invention will now be described in detail as follows:

FIG. 1 is a perspective view of one embodiment of blank for a container according to the present invention;

FIG. 2A–D show different stages in the folding of the blank to form a container;

Figure 5A:
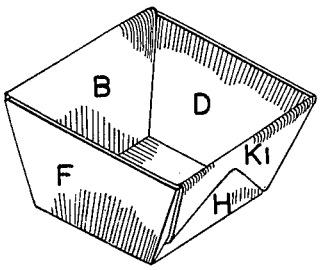

4C shows a completely constructed container according to the second embodiment with the flexible metal strip being bent to form a pouring spout;

FIG. 5A is a perspective view of the container.

Figure 6A:
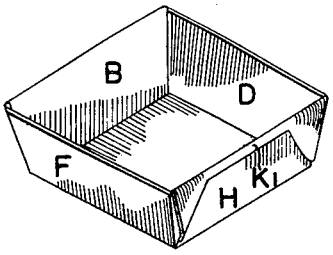
Figure 5B:
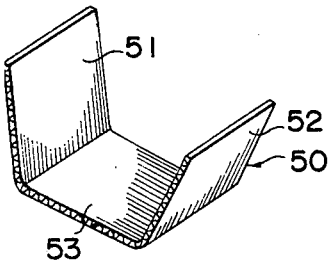
Figure 6B:
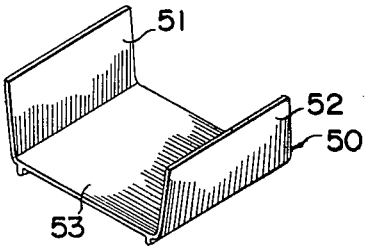
Figure 5C:
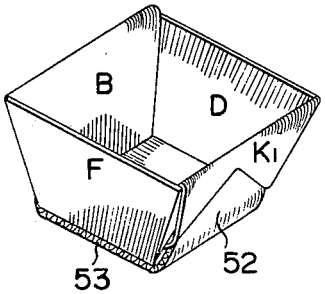

FIG. 5B shows a perspective view of a tray for use with the FIG. 5A container;

FIG. 5C shows the FIG. 5A container positioned in the FIG. 5B tray;

FIG. 6A shows another embodiment of the FIG. 5A container;

FIG. 6B shows another embodiment of the FIG. 5B tray; and

Figure 6C:
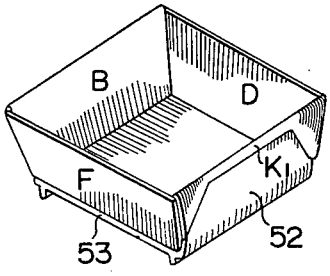

FIG. 6C shows the FIG. 6A container positioned in the FIG. 6B tray.

Figure 1:
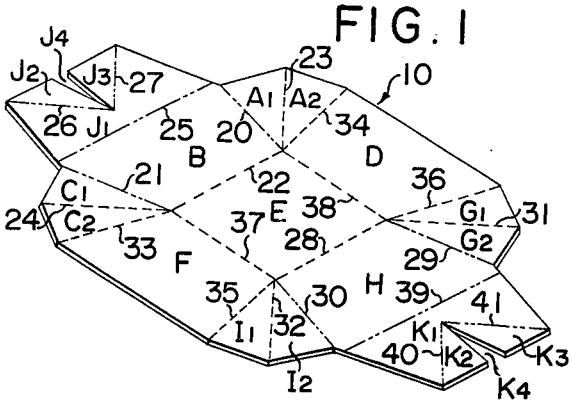
Figure 2D:
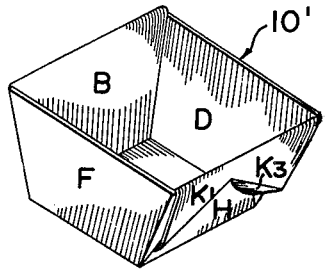
Figure 2A:
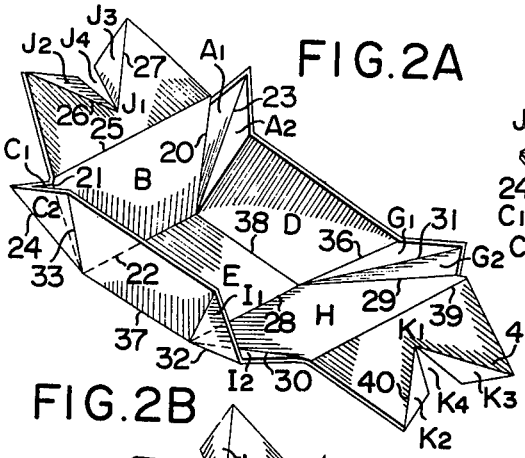

FIG. 1 shows a blank 10 for a container made of wood-free paper, glazed sulphite board or the like, of a suitable thickness, said blank being treated on at least one side with a water repellent, aluminum foil, plastic film, or other suitable waterproofing treatment, and cut to have the shape as shown, moreover, inwardly folding lines 22, 23, 24, 28, 31, 32, 37, 38 and outwardly folding lines 20, 21, 25, 29, 30, 33, 34, 35, 36, 39 are pressed by means of a roll-press onto the blank 10 dividing said blank, as seen in FIG. 1, into a square E, six trapezoids B, D, F, H, J1, K1 and eight triangles A1, A2, C1, C2, G1, G2, I1, I2 with central square E as the base of the container and adjacent trapezoids B, D, F, H as the side walls, of the container, said trapezoids B, D and F, H being completely symetrical. Corner triangles A1, A2, C1, C2, G1, G2, I1, I2 abut the corners between the plurality of side wall trapezoids, are stymetrical and form the corner holding members of the container. Lines 23, 24, 31, and 32 are the intermediate division between triangles A1 and A2, C1 and C2, G1 and G2, I1 and I2 respectively and are all inwardly folding lines. Adjacent to the free side of abovesaid trapezoidal side wall panels B, C are trapezoidal locking end panels J1 and K1, on the central portion of the top edge of which are provided slots J4 and K4 which are triangular in shape. Outwardly folding lines 26, 27, 40, 41 are roll-pressed along the diagonals between the outside corners of the trapezoidal locking end panels J1, K1 and the apex of said slots J4 and K4 forming symetrical triangles J2, J3, K2, K3.

The folding of blank 10 into a container will be described in detail according to FIGS. 2A, 2B, 2C, and 2D as follows:

As a first step, trapezoidal wall panels B, H and D, F are folded inwardly using inwardly folding lines 22, 28, and 37, 38 respectively to form the wall panels.

Next, triangles A1 and A2, C1 and C2, G1 and G2, and I1 and I2 are folded inwardly along inwardly folding lines 23, 24, 31 and 32 respectively so that each set of triangles meet face to face respectively, triangles A1 and A2, B1 and B2 are folded along outwardly folding lines 20, 21 towards wall panel B respectively until they meet said wall panel B. In the same manner, triangles G1 and G2, I1 and I2 are folded towards wall panel H along outwardly folding lines 29, 30 until they meet with said wall panel H thus forming holding corner members. Trapezoidal locking end panels J1 and K1, are folded outwardly along lines 25 and 39 respectively, and triangular portions J2, J3, K2, K3 are folded outwardly along outwardly folding lines 26, 27, 40 and 41 respectively. Triangular portions J2, J3, K2, K3 are then tucked into the fissure created between corner locking panels A1, C1, and G1, I1 and side wall panels B and H respectively, causing the walls of the container to be secure.

Figure 3:
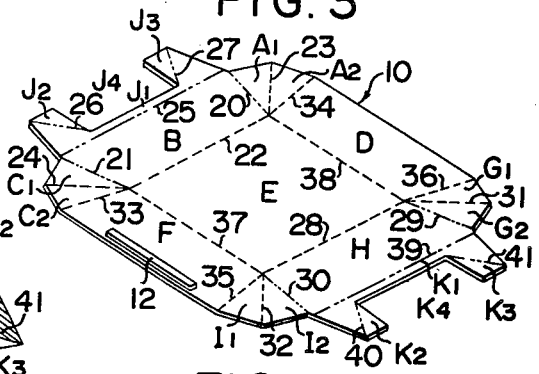
FIG. 3 is another embodiment of the container.
Figure 2B:
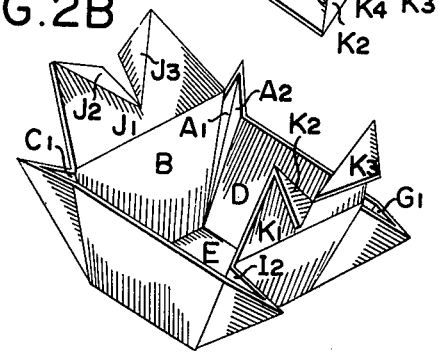

FIG. 3 is a second embodiment of the present invention. Container blank 10 varies from the first embodiment only in that the shape of the slot J4, K4 is trapezoidal rather then triangular. The folding method for this embodiment is identical to that of the first embodiment. End panel flaps of this kind are especially suitable for containers with lower walls, so as to form a dish or plate like container.

Figure 4A:
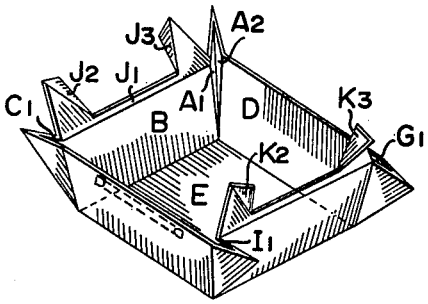
FIG. 4A shows a partially constructed container.
Figure 2C:
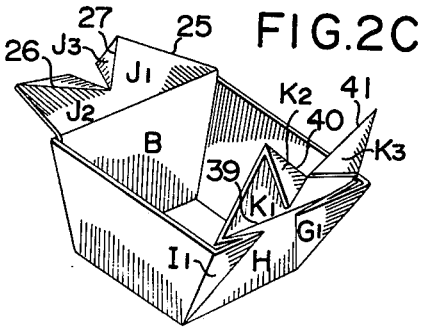
Figure 4B:
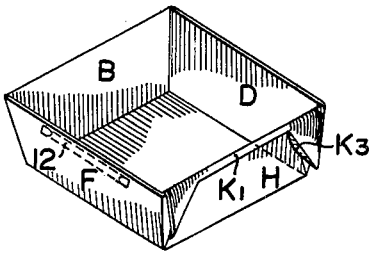
FIG. 4B shows a completely constructed container according to the second embodiment.
Figure 4C:
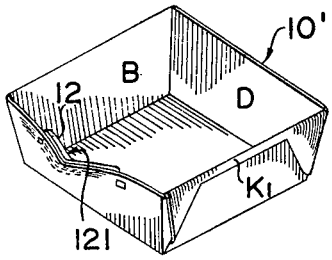

Although not shown in the diagrams, triangular and trapezoidal slots J4 and K4 can also be substituted by a straight cut perpendicular to the outer edge of locking end panels J1 and K1 without sacrificing any effectiveness of the invention. The reference number 12 of FIGS. 3, 4 refers to a flexible metal strip. This flexible metal strip 12 is provided on the inner side of an upper part of a wall F of the container and can be bent to form a V shaped spout when container is used for liquids.

FIG. 5 depicts an insulating tray made from corrugated card-board, metal, plastic, glass, ceramics or other suitable material. The tray 50 is U shaped, with sides 51 and 52 which are inserted between locking end panels J1 and K1 and wall panels B and H of the assembled container and the base 53 of the tray comes into contact with the base E of the container. When in use, the tray 50 will prevent the hands from being burned by hot soup or the like and will also discourage deformation of the container itself while adding strength and support.

In summary, this invention is a completely manually foldable container consisting of a blank of special design provided with roll-pressed fold lines which when assembled is waterproof and leakproof and which can be mass-produced inexpensively for use indoors or outdoors. Its industrial value is enhanced by its general convenience.

What I claim is:

1. A simple foldable container for foods and beverages characterized in that said container is formed from a blank made of a paper sheet of suitable hardness which is in the shape of a generally rectangular 16 sided polygon having roll-pressed thereon a plurality of inwardly and outwardly folding lines dividing the surface of the blank into one square, six trapezoids and eight triangles, said square being centrally located to serve as the base for the assembled container and adjacent symetrical trapezoids to serve as side walls, said symetrical trapezoids having pairs of symetrical triangles adjacent to the corners thereof to serve as holding members, one pair of oppositely located trapezoids having extending therefrom symetrical trapezoids to serve as locking panels having a slot cut at the central portion of the outer edge thereof, said slot being in the shape of a straight line, a triangle or a trapezoid, said locking panel also having roll-pressed thereon between the apex of the slot and the outside corners of the said trapezoid folding lines dividing both sides of said trapezoid into two symetrical triangles with said folding lines as the base thereof; first said symetrical trapezoids being inwardly folded around said inwardly folding lines to form wall panels, above said corner triangles being inwardly folded around said inwardly folding lines toward the side walls connected to said locking panels, above said locking panels being outwardly folded along outwardly folding lines, the said triangular portions thereof being inserted into the space between said triangular corner holding members and said side wall of locking panel to form a non-leaking container with the opening being larger than the base.

* * * * *